US005797771A

United States Patent [19]

Garside

[11] Patent Number: 5,797,771

[45] Date of Patent: Aug. 25, 1998

[54] CABLE CONNECTOR

[75] Inventor: R. Troy Garside, Bountiful, Utah

[73] Assignee: U.S. Robotics Mobile Communication Corp., Salt Lake City, Utah

[21] Appl. No.: 689,714

[22] Filed: Aug. 16, 1996

[51] Int. Cl.[6] ..... H01R 9/03

[52] U.S. Cl. ..... 439/610; 439/358; 439/76.1

[58] Field of Search ..... 439/607, 610, 439/76.1, 76.2, 493, 357, 358

[56] References Cited

U.S. PATENT DOCUMENTS

| | | | |
|---|---|---|---|
| 4,838,810 | 6/1989 | Yoshimura et al. | 439/358 |
| 4,857,008 | 8/1989 | Kee et al. | 439/358 X |
| 5,167,523 | 12/1992 | Crimmins et al. | 439/358 X |
| 5,380,223 | 1/1995 | Marsh et al. | 439/610 |
| 5,411,402 | 5/1995 | Bethurum | 439/76.1 |

*Primary Examiner*—Khiem Nguyen
*Attorney, Agent, or Firm*—Workman, Nydegger & Seeley

[57] ABSTRACT

An electrical connector particularly adapted for use in a PCMCIA standard connector designed for increased performance, ease of manufacturing, and allowing the connector casing to contain a printed circuit board having larger components is presented. A grounding shield with a hallowed-out area is implemented in the connector casing to create more room for a PC board given the same amount of vertical clearance allowing componentry to be larger than would otherwise be possible. Further, the grounding shield has a soldering cup to allow better adhesion of the solder to the plated grounding shield and to allow the connector to be more easily manufactured. The buttons used to disengage the connector from its receptacle are extended outward from the connection to provide easier accessibility in limited space circumstances. Additionally, the casing and buttons have opposing angles in order to provide more convenient and sure grasping by the user. The latch assembly has an innovative nipple area that allows the connector to be securely but less rigidly connected to allow permitting the connector to withstand larger jolts or shocks without receiving damage. Finally, a retention clip on the housing prevents the latch assembly from becoming stuck or damaging the PCMCIA card or receptacle.

8 Claims, 5 Drawing Sheets

CABLE CONNECTOR

BACKGROUND OF THE INVENTION

1. The Field of the Invention

The present invention relates to electrical connectors for connecting a cable containing a plurality of wires into a mating receptacle. More particularly this invention relates to electrical connectors for connecting a cable containing a plurality of wires to a PCMCIA card according to the PCMCIA standard. Furthermore, the present invention relates to innovations allowing the placement of Printed Circuit boards (PC boards) into the connector casing.

2. Present State of the Art

The field of electrical connectors is very diverse and many different connector designs exist. There are different challenges to be overcome depending upon the nature, circumstances, and purpose of the connection that dictate certain design constraints. For purposes of the present invention, the purposes, uses, and nature of a connector used to interface external cables into a mating receptacle found within an industry standard PCMCIA card residing in a personal computer, notebook computer, or other device will constitute the particular challenges met by connectors in the class of the present invention. Though illustrated in the context of a PCMCIA external cable connector, the following discussion and presentation of the invention refers to any connector that is faced with the same constraints and challenges as the PCMCIA external cable connector.

Because the PCMCIA cards and packaging were designed for a notebook computer and other reduced space availability applications, they are necessarily small and compact which reduces the area for external cable connection. The PCMCIA standard provides for the ability to make multiple external cable connections on the outward edge of a PCMCIA card through receptacles having a variety of configurations. Such connections are very close together making it difficult at times for the user to engage and disengage the housing portion of the connector from the receptacle residing in the card. Typically, engaging the cable is relatively straight forward with the user inserting the connector until the latch assemblies snap into place or "engage" the housing portion into the receptacle thereby assuring that the contacts are properly placed and the connector is secured.

Disengaging, however, requires that the user release a latch mechanism assembly by usually depressing some form of button or other means on the connector to disengage the nipple area portion of the latch assembly from the receptacle thereby allowing the user to greatly pull the housing portion away from the receptacle to fully remove the connector. Current connectors are deficient in that such disengaging means (i.e., buttons) are close to the receptacle end of the connector and in the constrained and miniaturized area of a PCMCIA environment it is often awkward and difficult to grasp or depress the disengagement means. Sometimes the buttons or other disengagement means are difficult to locate or grasp causing the user annoyance and irritation.

Because of the often portable nature of the PCMCIA environment, the external cable connectors are inserted and removed frequently as the user takes the portable computer from location to location. Therefore, any enhancements that make the process of inserting and removing the external cable connector with the receptacle in the PCMCIA card easier or more convenient for the user are advantageous. Furthermore, innovations in the reliability of the connection, enhanced durability of the connector, and ability to manufacture of the external cable connectors more efficiently provide significant competitive advantage in the marketplace. These advantages are enhanced goodwill associated with a high quality and reliable product as well as the cost savings that flow from efficient manufacture. Additionally, replacement costs are reduced as the reliability and durability of the product are increased.

One problem associated with PCMCIA connectors is the potential movement associated with going from a relatively solid basis at the receptacle within the PCMCIA card and the movable basis found at the cord. Certain moments of stress are associated with the common cord movement that frequently occurs in the portable environment and can occur in virtually any environment due to movement during connector insertion, users brushing the cables, etc. PCMCIA standards recognize certain enhancements to the receptacle-connector interface or injunction that reduces fracturing and damage due to this movement since this is the normal moment of stress due to both vertical and horizontal cord movement. Naturally, ways are sought to reduce the stresses and strains at the connector-receptacle interface so that vertical and horizontal cord movement do not over stress the componentry causing wear and damage.

Because the external cables are inserted and removed often, and users are not necessarily gentle in their engaging and disengaging in the latch assemblies with the receptacle, the connector is subjected to a relatively harsh environment. Because of such rough handling, users may at times "yank" the connector from the receptacle in the PCMCIA card before the housing is entirely disengaged from the receptacle causing damage to the connector housing (i.e., the portion of the connector holding the contacts that fits into the receptacle) and the latch assembly. At times, it may be advantageous to have the nipple areas of the latch adapted for easier disengagement in order to absorb the shocks and stresses subjected to the connector as sustained by common handling. Many in the industry have adapted the PCMCIA standard design in order to confront this problem as will be shown in more detail hereafter.

Depending on latch design, extended use and rough handling may provide opportunity for the latch to become lodged in the PCMCIA receptacle or card since some latch designs have the edge of the latch open to the receptacle. This may damage the connector, the receptacle, and some times the PCMCIA card itself and may cause the cable connector to be inoperable for future use.

Because of the increased complexity used in PCMCIA cards, it is becoming desirable to off-load some of this circuitry into a small PC board fitted within the connector casing (i.e., portion of the connector that resides external to the receptacle and PCMCIA card). Because of the tight space constraints in both the vertical and horizontal dimensions as well as a desire to keep the length of the connector casing as short as possible, outfitting the casing with a PC board can be a challenging process. For example, the connector casing usually contains a grounding shield, normally plated, thereby reducing the space available for even a small PC board. This problem becomes exacerbated when the componentry on the PC board becomes taller requiring every bit of available vertical space. It is desirable, therefore, to create the largest space possible for a PC board web while still fitting the casing within the recommended dimensions suggested in the PCMCIA standard specifications.

In conclusion, there are numerous problem areas that require attention of a cable connector manufacturer for connectors inserted into a receptacle found within a PCMCIA card. Manufacturers who address these problems effectively will see increased quality in the connector with attendant goodwill associated with such quality. Furthermore, costs can be reduced when cable replacement occurs less frequently. Finally, many manufacturing enhancements will further reduce costs associated with creating the connector and may do so simultaneously with creating a higher quality connector.

SUMMARY AND OBJECTS OF THE INVENTION

It is an object of the present invention to allow greater room for a PC board within an electrical cable connector casing by hollowing out the grounding shield to free up more vertical space thereby allowing a PC board with larger components to fit within a casing of a given size.

It is another object of the present invention to enhance the manufacture of an electrical cable connector.

It is yet another object of the present invention to make the insertion and removal of the electrical cable connector easier and more reliable for the user.

It is another object of the invention to prevent the latch of an electrical connector from becoming lodged in the mating receptacle.

It is a further object of the present invention to engage the connector housing of an electrical cable connector within the receptacle in such a manner that it may absorb the shocks and wear of rough handling without causing undue stress to the connector housing.

It is yet a further object of the present invention to focus movement of the cabling connected by an electrical cable connector so that the moment of stress are focused in some other position than at the connector-receptacle junction when cable movements are in the horizontal direction.

It is yet another object of the present invention to increase durability and decrease incidence of replacement for the manufactured electrical cable connector.

It is an object ofthe invention to provide a more ergonomic gripping mechanism in an electrical cable connector to aid in disengaging the housing from the receptacle to facilitate removal of the connector.

Additional objects and advantages of the invention will be set forth in the description which follows, and in part will be obvious from the description, or may be learned by the practice of the invention. The objects and advantages of the invention maybe realized and obtained by means of the instruments and combinations particularly pointed out in the appended claims.

To achieve the foregoing objects, and in accordance with the invention as embodied and broadly described herein a cable connector is provided.

The present invention as exemplified in improved electrical cable connector for a receptacle found within a PCMCIA card, and fitting within the constraints of the PCMCIA architecture is herein provided. The connector as implemented has a hollowed-out grounding shield that allows more vertical room for a PC board within the casing portion of the connector. Because of this, taller components may be populated on the PC board than otherwise would be possible thereby giving the PC board designer more flexibility and ability to create a wider variety of circuitry since taller components may be chosen.

To enhance ease of manufacture, the hollowed grounding shield also has a solder cup to allow for better adhesion of solder for connecting a ground wire. The hollowed grounding shield is typically plated for performance reasons which in turn creates a detriment in that solder is less likely to adhere and more difficult to manage. The soldering cup allows a larger amount of solder to be placed on the hollowed grounding shield and serves to form or direct the location of that solder making it easier to insert a wire therein.

In order to ease the effort required to insert and more particularly to remove the connector from the receptacle, a number of innovations are incorporated into the PCMCIA connector embodiment of the present invention. One such feature are the extended side buttons that disengage the nipple area of the latch from the receptacle. By extending the buttons lengthwise away from the receptacle end of the connector, a user need not reach as deeply in order to operate the buttons for disengagement of the connector housing from the receptacle as part of the removal of the connector itself.

Another feature to aid the user in operating the latch assembly for disengaging the housing and removing the connector is the opposing angles found on the connector casing and the protruding buttons that activate the latch. The connector casing has a greater width at the cable end than it does at the receptacle end thereby angling "inward." The protruding buttons are angled "outward" so that the button surface closest to the receptacle end protrudes slightly further than the button surface near the cable end. These opposing angles make it easy for the user to feel the buttons as she slides her fingers along the connector casing thereby providing simple and sure gripping of the buttons for the removal of the connector from the receptacle.

In order to deal with the customary handling of a connector, the present invention incorporates several features and innovations to increase reliability and decrease potential damage to the connector or the receptacle. First, a retention lip is incorporated on the connector housing in order to keep the receptacle end of the latch from extending outside of the housing. In this manner, the latch will not become lodged in the receptacle or damage the PCMCIA card.

Next, the nipple area of the latch has a secure but less rigid design that allows less force for disengagement from the receptacle yet retains a secure fit when properly engaged. This design prevents damage due to rough handling since heavy forces will tend to disengage the connector rather than break or damage components.

Finally, the grommet holding the cable into the connector is so ribbed that vertical movement is highly resisted while lateral movement is freely accomplished. This has the effect of reducing lateral moments of stress about the juncture between the connector housing and the receptacle. Since the most common movements exhibiting stress affects into the connector housing or onto the receptacle are lateral cable movements, reducing stress in primarily this direction increases durability and reliability.

The foregoing implementation of the present invention results in a number of added benefits, namely enhanced reliability, improved ease of manufacture, ease of use for the user in grasping and depressing the buttons for disengaging the connector, a connector with the ability to withstand rougher handling without damage, amongst others that naturally flow from the structures disclosed herein.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which:

FIG. 5A shows a side view of the latch and the standard nipple area while FIGS. 5B and 5C are cross-sectional, cut-away views of the latch in FIG. 5A.

FIG. 6C is a side view of a latch having the adapted nipple area while FIGS. 6B and 6C are cross-sectional, cut-away views of the latch in FIG. 6A.

FIG. 7A is a side view of a latch having the innovative nipple area while FIGS. 7B and 7C are cross-sectional, cut-away views of the latch shown in FIG. 7A.

DETAILED DESCRIPTION OF THE PREFERRED EMBODIMENTS

Figure 1:
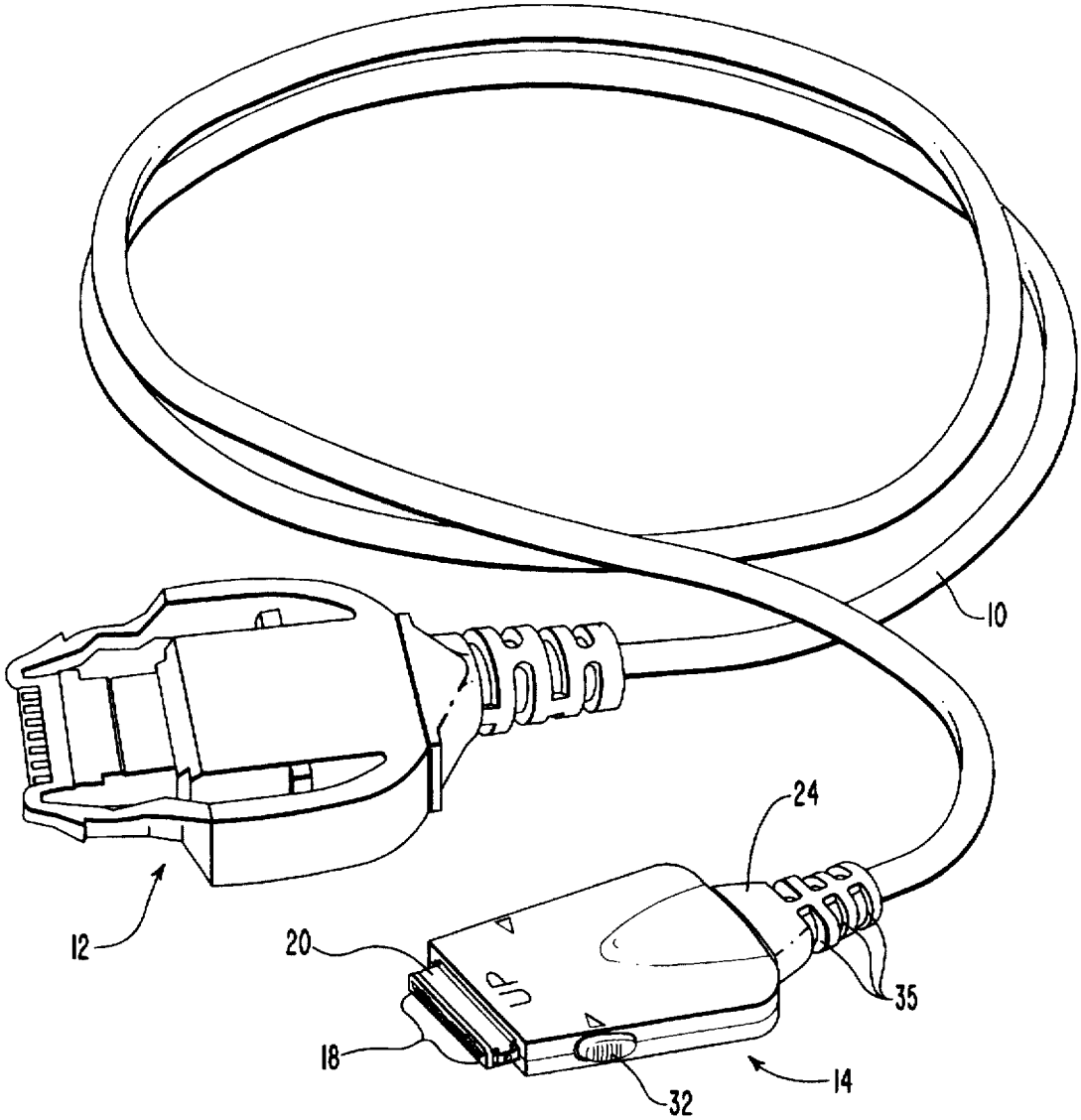
FIG. 1 shows an entire electrical cable including the improved PCMCIA connector embodiment of the present invention.

FIG. 1 shows a PCMCIA cable connector embodiment of the present invention wherein a cable 10 has a back end connector 12 for connection to some form of relevant electronic equipment and the PCMCIA connector 14 for connection to a PCMCIA card. It may be noted that throughout this application the terminology of a PCMCIA connector will be used but that the invention as claimed is not limited to only PCMCIA connectors. Any electrical connector that will benefit from the present invention will fit within the scope of the appended claims and the PCMCIA embodiment of the present invention is only illustrative of the invention and is not to be limiting.

Figure 2:
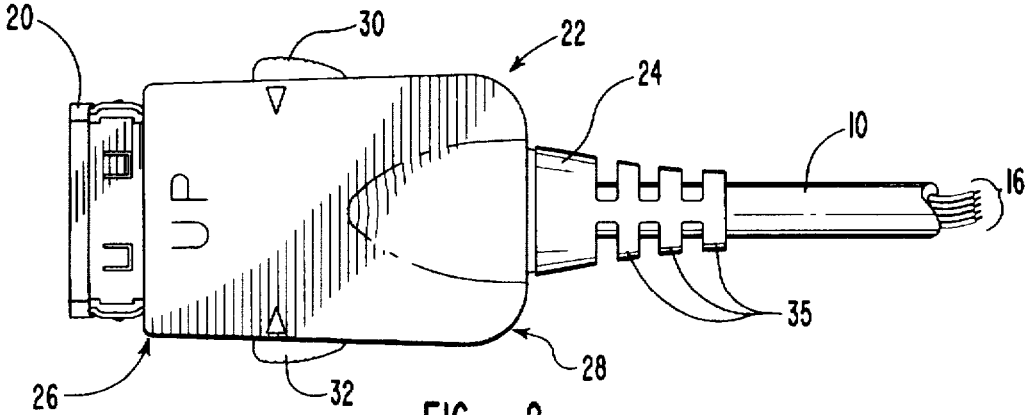
FIG. 2 is a top view of the electrical connector of FIG. 1 showing the opposing angles between the connector casing and the protruding buttons.

FIG. 2 is a top view of the connector 14 of FIG. 1. The cable 10 houses a plurality of wires 16 for connection to contacts 18 (not shown in FIG. 2) found within housing 20. The cable 10 is physically supported and connected by grommet 24. The connector casing 22 is narrower at the receptacle end 26 than at the cable end 28, causing the connector casing 22 to angle inwardly as followed from the cable end 28 to the receptacle end 26.

Protruding sideways out of the casing 22 are buttons 30 and 32 respectively. These buttons extend out through the casing 22 side walls. These buttons are for disengaging the housing 20 from the receptacle when connected (receptacle not shown). Note that buttons 30 and 32 angle outwardly from the cable end 28 of the connector to the receptacle end 26. The angling of the buttons 30 and 32 is in the opposite direction of the angling of the casing 22. The opposing angle orientation of the buttons 30 and 32 with respect to the casing 22 makes it easier for the user to grasp and depress buttons 30 and 32 for disengaging the housing from the receptacle.

Furthermore, buttons 30 and 32 are located further away from the housing 20 in the middle region of the casing 22 side walls (as opposed to the being located near the receptacle end) to allow easier access by the user. A user need not reach so deeply into a jangled mass of cables in order to reach the buttons 30 and 32 for removal of a particular connector since the buttons are thus located.

Figure 3:
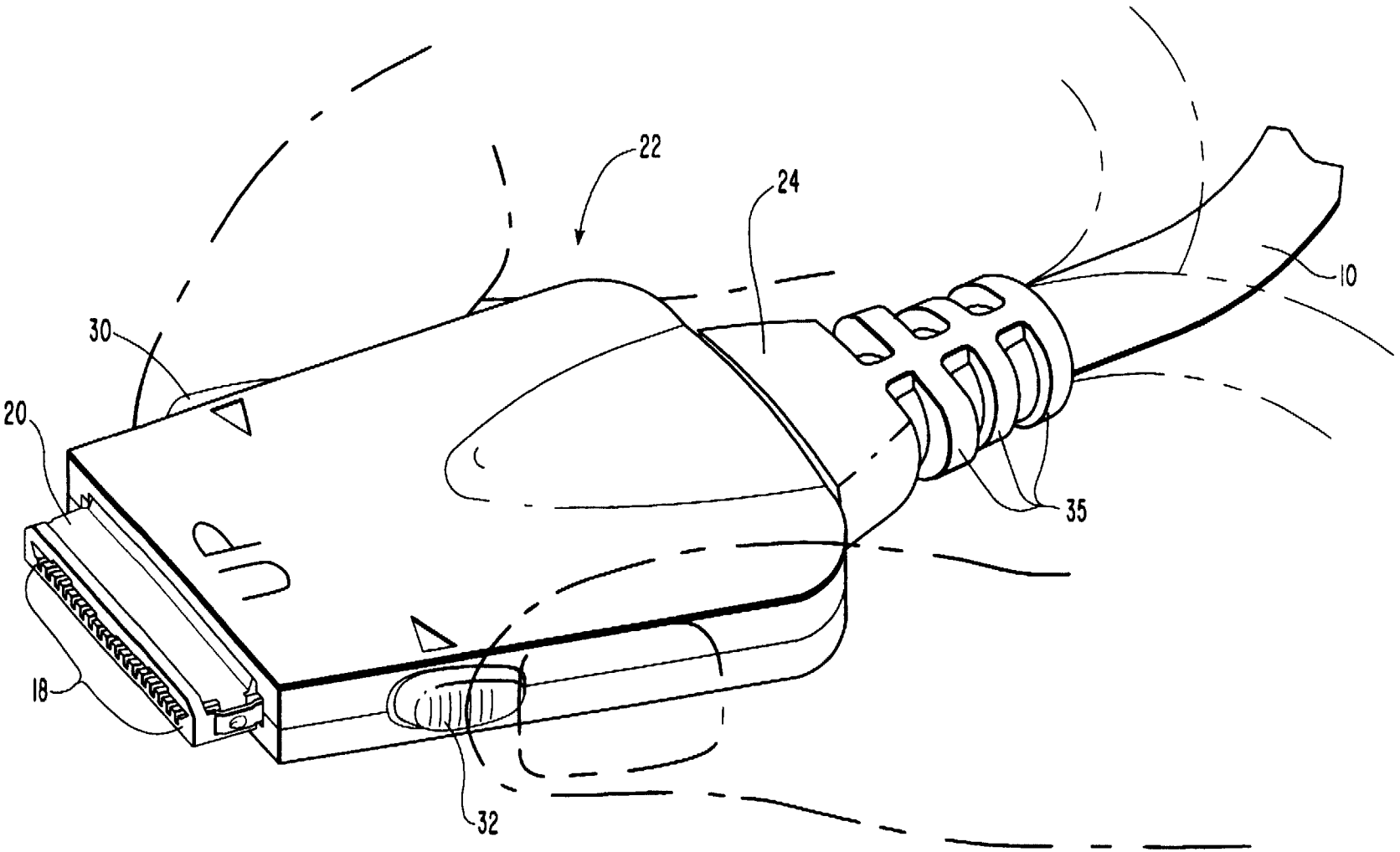
FIG. 3 is an operational view of the connector shown in FIGS. I and 2 with an outlined hand showing the finger placement for operating the protruding buttons and showing the lateral movement of the cable during operation as constrained by the grommet.

FIG. 3 shows the connector 14 of FIG. 1 in closeup showing how a user will operate the buttons 30 and 32. Furthermore, grommet 24 having ribs 35 that allow lateral movement of the cable 10 readily while resisting vertical movement. This will tend to reduce strain at the connector receptacle junction when encountering lateral movements, the most common type of movement. It may be noted that other forms of strain relief grommets may be used and those skilled in the art will optimize the strain relief to reduce strain at the connector receptacle junction as well as support the cable properly so that the internal plurality of wires 16 are supported and do not become detached by movement of the cable 10. The optimum level of cable movement in both the vertical and horizontal (lateral) directions is determined by environment and common usage.

Figure 4:
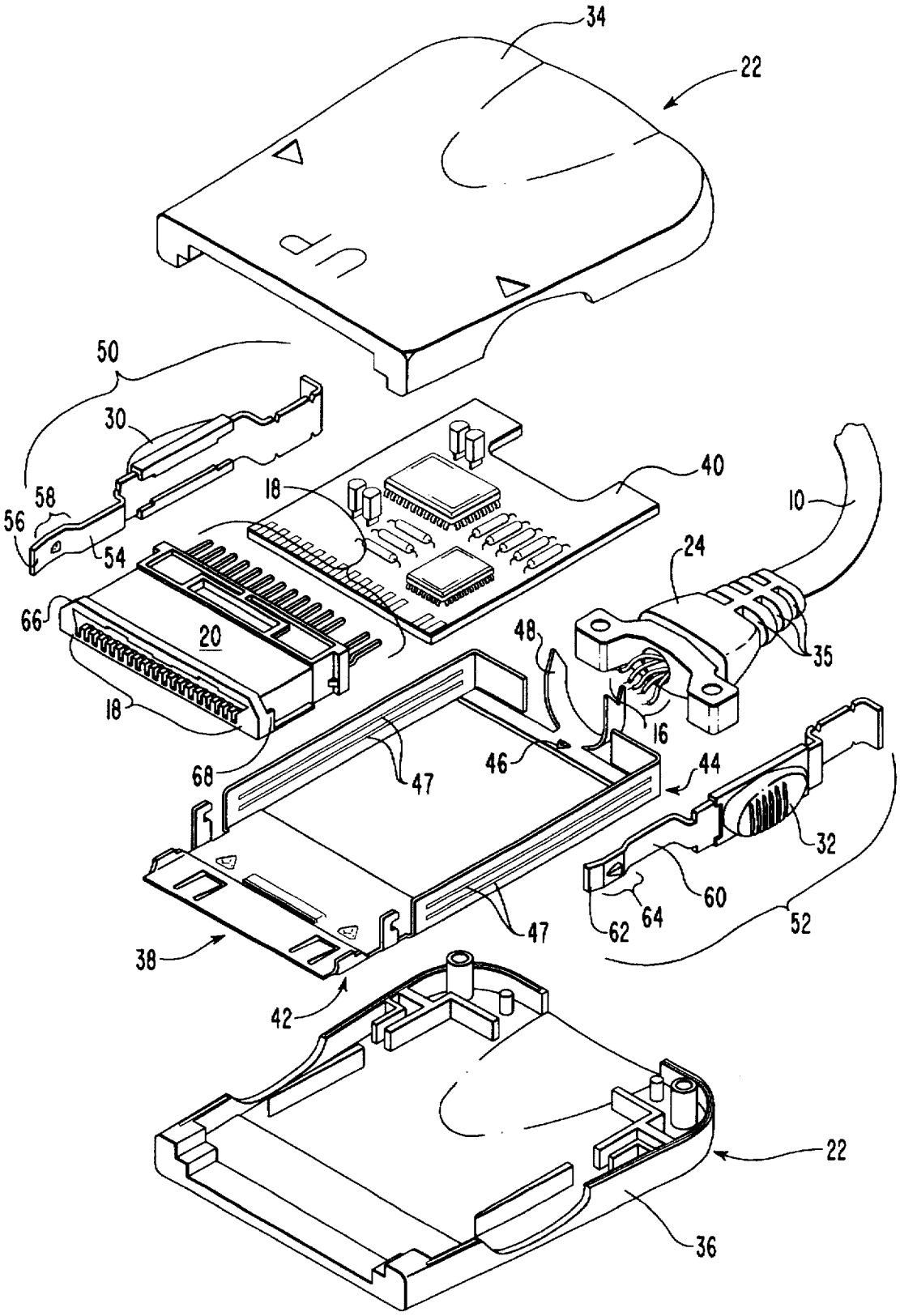
FIG. 4 is an exploded perspective view of the connector shown in FIGS. 1, 2 and 3 to illustrate the different parts of the connector.

FIG. 4 is an exploded perspective view of the PCMCIA connector 14 shown in FIG. 1 showing detail of the various parts. The casing 22 as indicated in FIGS. 2 and 3 is composed of an upper casing half 34 and a lower casing half 36 that defines an internal cavity. The casing halves, 34 and 36 respectively, may be impregnated with conductive material during molding in order to make the casing 22 conductive thereby obviating the need for a separate grounding shield in certain circumstances. While metal particles such as copper can be used, they may be detrimental to the injection molds used in constructing the casing 22. Graphite particles have been shown to be more injection mold friendly and still provide the conductive characteristics in the casing 22 to obviate the need for a separate grounding shield.

Within the casing created by upper casing half 34 and lower casing half 36 is a hollowed grounding shield 38 and PC board 40. The hollowed grounding shield 38 is different from other shields in that there is a hollowed area that allows a taller populated PC board 40 to fit within the cavity of casing 22. By hollowing the grounding shield 38 there is more room with no substantial performance degradation in the grounding shield itself. Further, the PC board 40 will be wrapped in foil or otherwise grounded and shielded so that no functionality is lost in the hollowing of the hollowed grounding shield 38.

The hollowed grounding shield 38 has a receptacle end 42 and a cable end 44. On the cable end 44 are a solder well 46 and cable crimp 48. The cable crimp 48 will securely hold cable 10 so that the plurality of wires 16 connected to the PC board 40 will be stable with one of the plurality of wires 16 being soldered to the hollowed grounding shield 38 at the solder well 46.

Because the hollowed grounding shield 38 is normally plated, it is sometimes difficult to make a solder connection. Making the solder connection on certain plated surfaces may require a larger amount of solder than would be required on a non-plated article and handling such greater solder mass can be messy and difficult. By including solder well 46, the increased mass of solder is readily guided to a desired location while also maintaining a larger surface area in order to get a proper attachment. This results in ease in making the solder connection thereby creating a manufacturing efficiency. Furthermore, the connection is more precise and durable thereby enhancing the quality of the connector. Note also the longitudinal strength dimples 47 found in the sides of the hollowed grounding shield that provide strength and resistance to downward crushing forces on the hollowed grounding shield 38 which would also tend to protect the PC board 40 contained within the hollowed area.

Because of the vertical size constraints, PC board 40 is typically made as thin as possible. Such thinness heightens susceptibility to bending that can cause the internal board traces to fracture thereby disrupting circuit operation or cause the board to disconnect from either the contacts 18 or any of the plurality of wires 16 attached thereto. The strength dimples 47 strengthen the hollowed grounding shield 38 so that the PC board 40 mounted thereon has additional resistance to flexing and the inherent problems therewith.

The PC board 40 has attached on one end the plurality of wires 16 that are enclosed in cable 10. At the other end, the PC board 40 is connected to the contacts 18, the contacts extending through the housing 20. When the housing 20 is inserted into the receptacle, the contacts will create a conductive path between the plurality of wires 16 within cable 10 through the connector by way of PC board 40.

The PC board 40 contains circuitry and electronic components that interact with the signals found on the plurality of wires 16 connected thereto and on the contacts 18 connected thereto. The PC board 40 may be used to off-load circuitry from the PCMCIA card or any other purpose deemed important by the designer. The hollowed grounding shield 38 (or alternatively, a conductive casing obviating the need for a grounding shield) allows more vertical clearance for a PC board giving a designer more flexibility in choosing components thereby providing a greater variety of potential circuitry that may be contained therein.

The housing 20 and contacts 18 are held securely into the receptacle or "engaged" by latch assemblies 50 and 52 respectively that lie within casing 22. Latch assembly 50 comprises button 30 attached to latch 54, with latch 54 having a latch end 56 and a latch nipple area 58. In like manner, the latch assembly 52 comprises button 32 attached to latch 60, latch 60 in turn having a latch end 62 and a latch nipple area 64. It is the latch nipple areas 58 and 64 respectively that engage the receptacle to secure the connector in place and their specific geometry will be discussed hereafter.

As noted previously, latch ends 56 and 62 may sometimes become lodged into the receptacle causing damage to the connector and possibly damaging to the receptacle or PCMCIA card. In order to overcome such problems, housing 20 has incorporated therein retention lips 66 and 68 respectively. The retention lips 66 and 68 will ensure that latch ends 56 and 62, respectively, are kept within the confines of the housing and not become lodged into the receptacle.

Figure 5A:
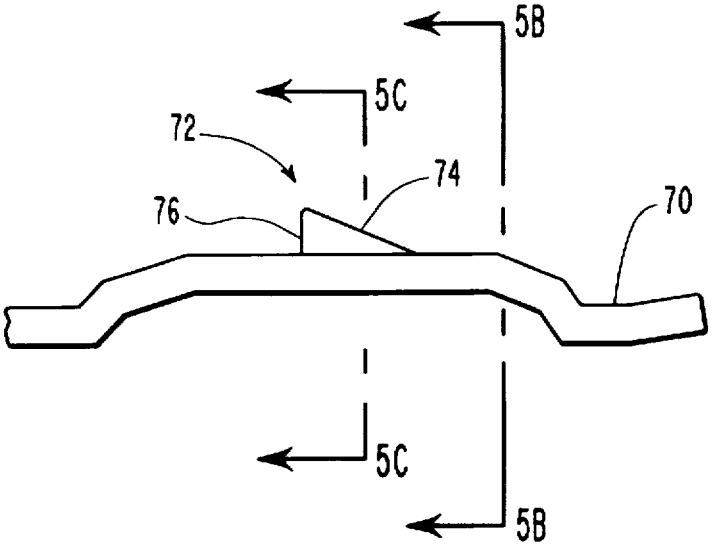
FIG. 5A (PRIOR ART)
FIGS. 5A–5C are drawings depicting a latch with a rigid locking nipple area.
Figure 5B:
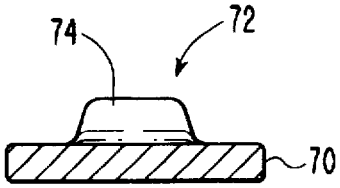
FIG. 5B (PRIOR ART)
Figure 5C:
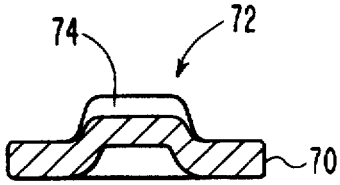
FIG. 5C (PRIOR ART)

FIG. 5A–5C are drawings showing a latch with a rigid locking nipple area. FIG. 5A is a side view of the latch while FIGS. 5B and 5C are perpendicular cross-sections of the latch in FIG. 5A. The latch 70 with rigid locking nipple area 72 has a flat, sloped face 74 the rises and transitions to a straight edge 76 for engaging the receptacle firmly. The straight edge 76 firmly and securely engages the receptacle, however, when the connector is subject to rough handling and other shocks, the rigid connection sometimes will cause damage to the connector or the receptacle.

Figure 6A:
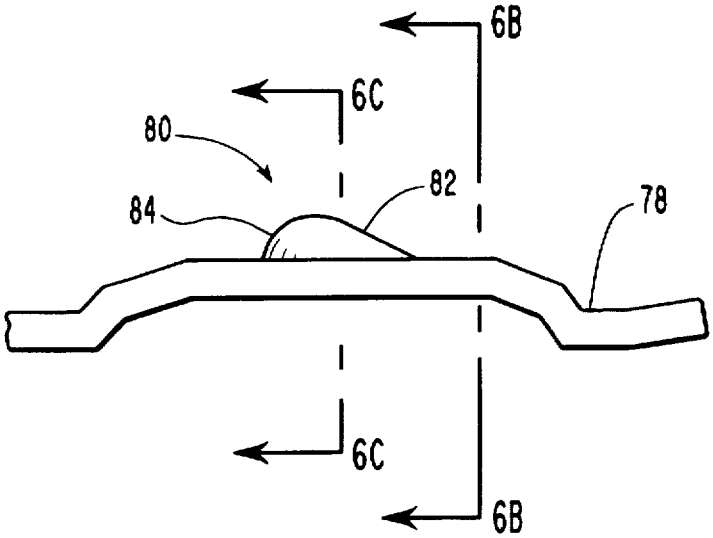
FIG. 6A (PRIOR ART)
FIGS. 6A–6C are drawings depicting a latch with an industry adapted nipple area for handling the shocks and stresses of cable movement.
Figure 6B:
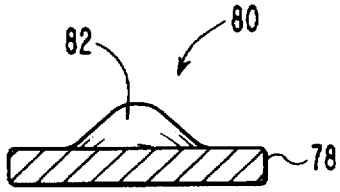
FIG. 6B (PRIOR ART)
Figure 6C:
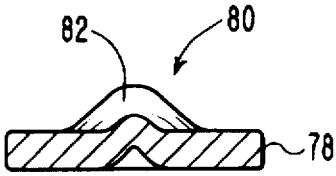
FIG. 6C (PRIOR ART)

In order to overcome these problems, many in the industry have adopted an alternative design for the nipple area. This is illustrated in FIGS. 6A–6C where 6A is a side view of a latch having the adapted nipple and FIGS. 6B and 6C are cut-away, cross-sections of that latch taken at different positions. The latch 78 has a teardrop shaped adapted nipple area 80. The nipple area face 82 is gently sloped and rounded as can best be seen from the cross-sectional view. After reaching its crest, the adapted nipple area 80 has a rounded engagement area 84 for engaging the receptacle and securing the connector in place. While this adapted latch will adequately absorb shocks, and provide relative ease for a user trying to disengage the housing from the receptacle, removing the straight edge sometimes compromises a secure connection. This makes the connector susceptible to being dislodged by everyday handling of the connected cable which can be a nuisance and a bother to the user who may suddenly lose an important connection.

Figure 7A:
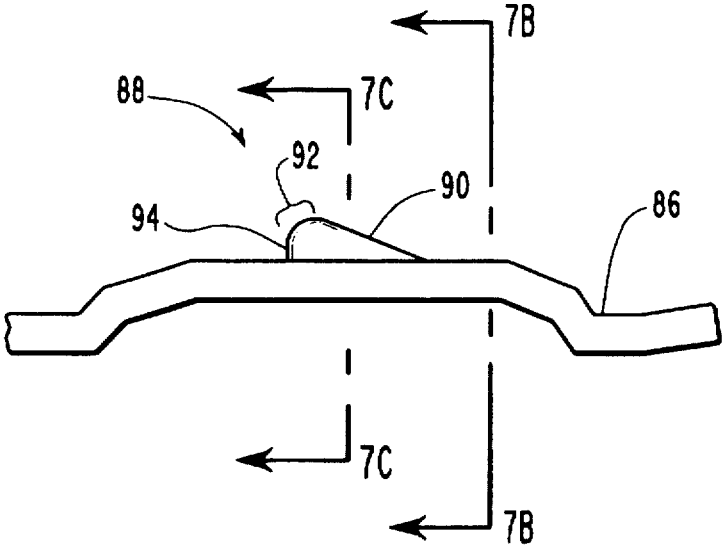
FIG. 7A (PRIOR ART)
FIGS. 7A–7C show a latch having a nipple area according to the present invention.
Figure 7B:
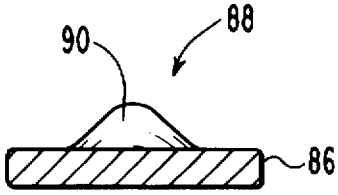
FIG. 7B (PRIOR ART)
Figure 7C:
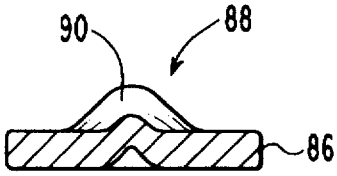
FIG. 7C (PRIOR ART)

FIGS. 7A–7C show a new latch design incorporating the present invention that overcome the deficiencies of the current industry nipple designs. FIG. 7A is a side view of the new latch showing an innovative nipple area while FIGS. 7B and 7C are edge-wise, cross-sectional cuts of the latch in 7A. The latch 86 has an innovative nipple area 88 comprising a tear-shaped front face 90 that is the same as the conventional industry adaptation as described in connection FIGS. 6A–6C. Once the slope crests, there is a post-crest transition surface 92 that transitions to a substantially straight engagement edge 94, the engagement edge 94 providing the same secure engagement as does the rigid locking nipple area design as explained in connection with FIGS. 5A–5C. Engagement edge 94 does not extend to the crest of the nipple area thereby allowing the latch to disengage through the transition surface 92 when a shock occurs before damage occurs to the latch or the receptacle thereby protecting the connector and the receptacle from damage. The transition surface may be an arcuate radius alone or may contain a flattened portion therein. This innovative nipple area 88 provides substantial advantage over both the rigid locking design and the industry adaptation design for dealing with the stresses and realities of the real world. Because of this innovative nipple area design, a connector so constructed will be able to lodge very securely yet also absorb the shocks and stresses of harsh cable movement without damaging the connector or the receptacle.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A cable connector for connecting a cable containing a plurality of wires into a mating receptacle, the cable connector comprising:

a casing having a receptacle end, a cable end, and respective first and second side walls connecting the two ends, the casing further defining a cavity;

a housing connected to the receptacle end of the casing for fitting into the mating receptacle;

a grommet connected to the cable end of the casing to support the cable containing the plurality of wires;

contacts held by the housing for electrical connection within the mating receptacle;

a hollowed grounding shield located in the casing cavity and electrically connected to the plurality of wires, the grounding shield being hollowed-out to lessen vertical space impact within the casing cavity; and a PC board located within the casing cavity and fitting in the hollowed out portion of the grounding shield, the PC board being electrically connected to the plurality of wires within the cable and to the contacts.

2. A cable connector as recited in claim 1 wherein the casing cable end is wider than the casing receptacle end forming an inward angle in the respective casing side walls between the two ends and further comprising first and second buttons protruding out of the respective casing side wall with each button angling away from the respective casing side wall as viewed from the cable end to the receptacle end so as to be of opposite angle than that of the respective casing sidewall itself to allow easy button access.

3. A cable connector as recited in claim 1 wherein each respective casing side wall have a middle region and further comprising first and second buttons protruding out of the respective casing side walls in the middle region to allow easy access to the respective buttons.

4. A cable connector as recited in claim 1 wherein the housing further comprises sides each having formed therein a latch retention lip and further comprising a right and left latch assembly located within the casing adjacent to respective first and second casing side walls and extending therefrom alongside the housing, each latch assembly comprising a latch having a receptacle end and a nipple area, and a button attached to the latch, each button protruding out of the respective casing side wall wherein each respective latch receptacle end is contained by the respective latch retention lip from extending beyond the confines of the housing so as to prevent the latch receptacle ends from lodging in the receptacle.

5. A cable connector as recited in claim 1 further comprising a right and left latch assembly located within the casing adjacent to respective first and second casing side walls and extending therefrom alongside the housing, each latch assembly comprising a latch having a receptacle end and a nipple area, and a button attached to the latch, each button protruding out of the respective casing side wall, the nipple area gently sloping to a crest and passing through a transition surface to an engagement edge to allow less rigid engagement of the receptacle.

6. A cable connector as recited in claim 1 wherein the grommet is ribbed to allow lateral cable motion but resist vertical cable motion.

7. A cable connector as recited in claim 1 wherein the hollowed grounding shield has therein a solder well to allow easier adhesion of solder for connecting one of the plurality of wires during manufacture.

8. A cable connector for connecting a cable containing a plurality of wires into a mating receptacle, the cable connector comprising:

a casing having a receptacle end, a cable end, respective first and second casing side walls having respective first and second middle regions and connecting the two ends, with the cable end being wider than the receptacle end forming an inward angle in the respective side walls between the two ends, the casing further defining a cavity;

a housing connected to the receptacle end of the casing for fitting into the mating receptacle, the housing having sides each having formed therein a latch retention lip;

a grommet connected to the cable end of the casing to support the cable containing the plurality of wires, the grommet being ribbed to allow lateral cable motion but resisting vertical cable motion;

contacts held by the housing for electrical connection within the mating receptacle;

a hollowed grounding shield located in the casing cavity and electrically connected to the plurality of wires, the grounding shield being hollowed out to lessen vertical space impact within the casing cavity and having a solder well to allow easier adhesion of solder for connecting one of the plurality of wires during manufacture;

a PC board located within the casing cavity and fitting in the hollowed out portion of the grounding shield, the PC board being electrically connected to the plurality of wires within the cable and to the contacts; and a right and left latch assembly located within the casing adjacent to respective first and second casing side walls and extending therefrom alongside the housing, each latch assembly comprising a latch having a receptacle end and a nipple area, and an angled button attached to the latch, the nipple area gently sloping to a crest and passing through a transition surface to an engagement edge, and each button protruding out of the respective casing side wall and angling away from the respective casing side wall as viewed from the cable end to the receptacle end so as to be of opposite angle than that of the respective casing side wall itself with each button located in the respective middle region to allow easy button access.

* * * * *

UNITED STATES PATENT AND TRADEMARK OFFICE

CERTIFICATE OF CORRECTION

PATENT NO. : 5,797,771

DATED : Aug. 25, 1998

INVENTOR(S) : R. Troy Garside

It is certified that error appears in the above-identified patent and that said Letters Patent is hereby corrected as shown below:

Cover Page, Abstract, line 6, before "area" change "hallowed-out" to --hollowed-out--

Cover Page, Abstract, line 19, after "allow" delete --permitting--

Col. 1, line 67, before "the external" delete --of--

Col. 2, line 31, after "that" change "fits" to --fit--

Col. 3, line 32, after "that the" change "moment" to --moments--

Col. 3, line 38, after "object" change "ofthe" to --of the--

Col. 3, line 46, after "invention" change "maybe" to --may be--

Col. 4, line 49, after "stress" change "affects" to --effects--

Col. 5, line 17, before "and 2" change "FIGS. I" to --FIGS. 1--

Col. 5, line 55, after "of the" insert --PCMCIA--

Col. 6, line 15, after "shows the" insert --PCMCIA--

Col. 6, line 17, after "24" change "having" to --has--

Col. 7, line 65, after "74" change "the" to --that--

UNITED STATES PATENT AND TRADEMARK OFFICE

CERTIFICATE OF CORRECTION

PATENT NO. : 5,797,771

DATED : Aug. 25, 1998

INVENTOR(S) : R. Troy Garside

It is certified that error appears in the above-identified patent and that said Letters Patent is hereby corrected as shown below:

Col. 8, line 23, after "that" change "overcome" to --overcomes--

Col. 8, line 29, after "connection" insert --with--

Col. 9, line 23, after "wall" change "have" to --has--

Signed and Sealed this

Third Day of August, 1999

*Attest:*

*Attesting Officer*

Q. TODD DICKINSON

*Acting Commissioner of Patents and Trademarks*